US011644208B2

(12) United States Patent
Kwak et al.

(10) Patent No.: US 11,644,208 B2
(45) Date of Patent: May 9, 2023

(54) AIR CONDITIONER AND METHOD FOR DETECTING INCORRECTLY CONNECTED PIPE IN AN AIR CONDITIONER

(71) Applicant: LG ELECTRONICS INC., Seoul (KR)

(72) Inventors: Min Suk Kwak, Seoul (KR); Gilun Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/557,350

(22) Filed: Dec. 21, 2021

(65) Prior Publication Data

US 2022/0196273 A1 Jun. 23, 2022

(30) Foreign Application Priority Data

Dec. 22, 2020 (KR) ..... 10-2020-0181160

(51) Int. Cl.

| | |
|---|---|
| ***F24F 11/49*** | (2018.01) |
| ***F24F 11/64*** | (2018.01) |
| ***F24F 11/84*** | (2018.01) |
| ***F24F 11/86*** | (2018.01) |
| *F24F 140/20* | (2018.01) |
| *F24F 140/12* | (2018.01) |

(52) U.S. Cl.

CPC ..... *F24F 11/49* (2018.01); *F24F 11/64* (2018.01); *F24F 11/84* (2018.01); *F24F 11/86* (2018.01); *F24F 2140/12* (2018.01); *F24F 2140/20* (2018.01)

(58) Field of Classification Search

CPC .. F24F 11/49; F24F 11/64; F24F 11/84; F24F 11/86; F24F 11/38; F24F 1/32; F24F 2140/12; F24F 2140/20

See application file for complete search history.

(56) References Cited

U.S. PATENT DOCUMENTS

| | | | | |
|---|---|---|---|---|
| 5,603,225 A * | 2/1997 | Tobi | G05B 19/0423 236/51 |
| 5,630,324 A * | 5/1997 | Yoshida | F24F 11/52 236/51 |
| 2019/0128550 A1* | 5/2019 | Campos | H04Q 9/00 |

FOREIGN PATENT DOCUMENTS

| | | |
|---|---|---|
| KR | 10-0382504 | 11/2002 |
| KR | 10-2005-0120068 | 12/2005 |
| KR | 10-0630450 | 12/2005 |
| KR | 10-2006-0055223 | 5/2006 |
| KR | 10-2011-0102042 | 9/2011 |

OTHER PUBLICATIONS

Korean Notice of Allowance dated May 24, 2022.

* cited by examiner

*Primary Examiner* — Marc E Norman
(74) *Attorney, Agent, or Firm* — Ked & Associates

(57) ABSTRACT

An air conditioner and a method for detecting an incorrectly connected pipe in an air conditioner are provided. The air conditioner may detect an incorrectly connected pipe by performing a serial pipe inspection when three or less indoor units are connected to an outdoor unit through pipes and performing a group pipe inspection when four or more indoor units are connected to the outdoor unit through the pipes. The structure may enable detecting the incorrectly connected pipe among pipes connecting the outdoor unit to the indoor units within a shorter time.

20 Claims, 8 Drawing Sheets

FIG. 6

| STATE | FIRST INDOOR UNIT | SECOND INDOOR UNIT | THIRD INDOOR UNIT | DETECTION RESULT |
|---|---|---|---|---|
| NORMAL | 1 | 2 | 3 | NORMAL STATE |
| CROSS-CONNECTED | 2 | 1 | 3 | UNDETECTABLE STATE |
| OMITTED | 1 | 4 | 3 | ERROR STATE |
| DUPLICATED | 1 | 1 | 3 | ERROR STATE |

FIG. 7

| TIME PERIOD | INDOOR UNITS | | | | | | | | |
|---|---|---|---|---|---|---|---|---|---|
| | FIRST GROUP | | | SECOND GROUP | | | THIRD GROUP | | |
| | 1 | 2 | 3 | 4 | 5 | 6 | 7 | 8 | 9 |
| t1 | O | O | O | X | X | X | X | X | X |
| t2 | X | X | X | O | O | O | X | X | X |
| t3 | X | X | X | X | X | X | O | O | O |
| t4 | O | X | X | O | X | X | O | X | X |
| t5 | X | O | X | X | O | X | X | O | X |

FIG. 8

| TIME PERIOD | INDOOR UNITS | | | | | | |
|---|---|---|---|---|---|---|---|
| | FIRST GROUP | | | SECOND GROUP | | | THIRD GROUP |
| | 1 | 2 | 3 | 4 | 5 | 6 | 7 |
| t1 | O | O | O | X | X | X | X |
| t2 | X | X | X | O | O | O | X |
| t3 | X | X | X | X | X | X | O |
| t4 | O | X | X | O | X | X | O |
| t5 | X | O | X | X | O | X | X |

FIG. 9

| TIME PERIOD | INDOOR UNITS | | | | |
|---|---|---|---|---|---|
| | FIRST GROUP | | | SECOND GROUP | |
| | 1 | 2 | 3 | 4 | 5 |
| t1 | O | O | O | X | X |
| t2 | X | X | X | O | O |
| t3 | O | X | X | O | X |
| t4 | X | O | X | X | O |

AIR CONDITIONER AND METHOD FOR DETECTING INCORRECTLY CONNECTED PIPE IN AN AIR CONDITIONER

CROSS-REFERENCE TO RELATED APPLICATION(S)

This application claims priority under 35 U.S.C. § 119 to Korean Patent Application No. 10-2020-0181160, filed in Korea on Dec. 22, 2020, in the Korean Intellectual Property Office (KIPO), the disclosure of which is incorporated by reference herein in its entirety.

BACKGROUND

1. Field

An air conditioner capable of detecting an incorrectly connected pipe among pipes connecting outdoor units to indoor units and a method for detecting an incorrectly connected pipe in an air conditioner are disclosed herein.

2. Background

A multi-air conditioning apparatus of an air conditioner may connect a plurality of indoor units to at least one outdoor unit through a single pipe system to control air in a plurality of indoor spaces. The indoor unit installed in each indoor space among the plurality of indoor spaces may perform a cooling operation or a heating operation. In addition, some of the plurality of indoor units may perform the cooling operation and the other indoor units may perform the heating operation.

The multi-air conditioning apparatus in related art may close indoor units one by one to inspect pipes when electronic expansion valves connecting the indoor units to the outdoor units are all opened. In this case, stability of the system may be obtained; however, a stabilization time period of a refrigeration cycle for the pipe inspection may be increased. In addition, the multi-air conditioning apparatus may sequentially inspect the indoor units one by one, so a lot of time may be consumed accordingly as a large number of indoor units are connected to the outdoor units.

In addition, when the indoor units are grouped using a binary tree method according to operation modes thereof, all indoor units may be grouped by 50% or the indoor units may be grouped through a combination thereof. This grouping method may shorten the total operation time; however, this method may consume a longer time to stabilize the refrigeration cycle than the above method according to a capacity of the connected indoor unit and a length of the pipe, and may increase a probability of incorrect detection.

BRIEF DESCRIPTION OF THE DRAWINGS

Embodiments will be described in detail with reference to the following drawings in which like reference numerals refer to like elements, and wherein:

FIG. 6 shows example pipe address information allocated to each indoor unit, by an outdoor unit and stored in the outdoor unit, and detection results thereof;

FIG. 7 shows an example of performing a group pipe inspection of an air conditioner according to an embodiment;

FIG. 8 shows an example of performing a group pipe inspection when an air conditioner includes seven indoor units according to an embodiment; and FIG. 9 shows an example of performing a group pipe inspection when an air conditioner includes five indoor units according to an embodiment.

DETAILED DESCRIPTION

Figure 1:
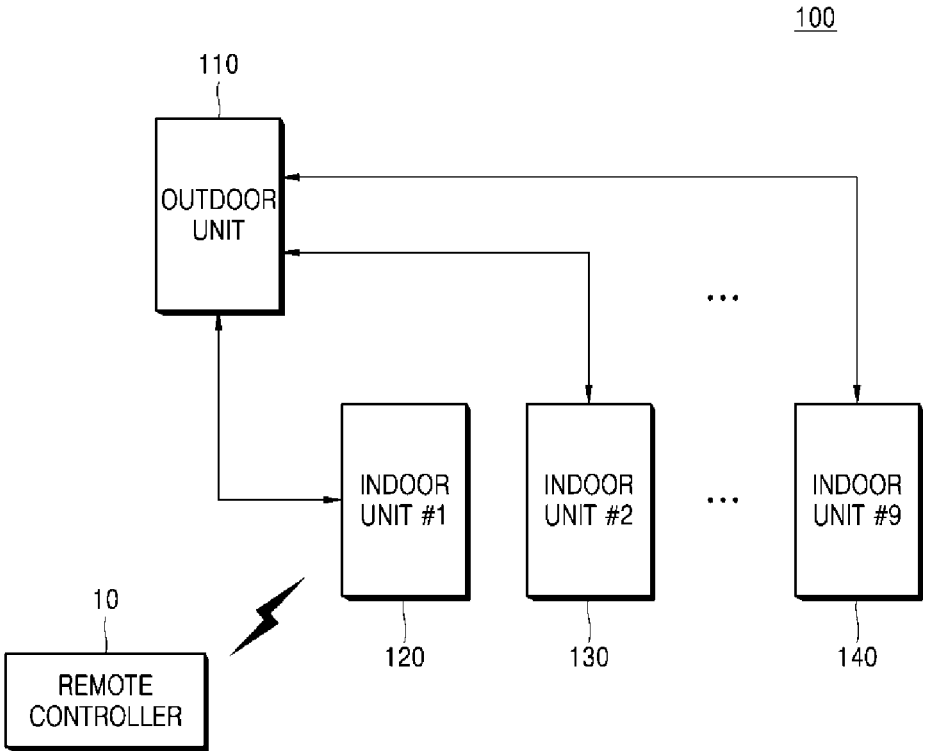
FIG. 1 is a schematic diagram of an air conditioner according to an embodiment.

Embodiments will be described with reference to accompanying drawings, such that a person having ordinary knowledge in the art to which the embodiments pertain may easily implement the technical idea. Description of well-known technology relating to the embodiments may be omitted if it unnecessarily obscures the gist. One or more embodiments are described with reference to the accompanying drawings. Same reference numerals may be used to refer to same or similar components.

It will be understood that, the terms "first", "second", and the like may be used herein to describe various components; however, these components should not be limited by these terms. These terms are only used to distinguish one component from another component. Thus, a first component may be a second component unless otherwise stated.

Unless otherwise stated, each component may be singular or plural through the disclosure.

In this document, the terms "upper," "lower," "on," "under," or the like are used such that, where a first component is arranged at "an upper portion" or "a lower portion" of a second component, the first component may be arranged in contact with the upper surface or the lower surface of the second component, or another component may be disposed between the first component and the second component. Similarly, where a first component is arranged on or under a second component, the first component may be arranged directly on or under (in contact with) the second component, or at least one other components may be disposed between the first component and the second component.

Further, the terms "connected," "coupled," or the like are used such that, where a first component is connected or coupled to a second component, the first component may be directly connected or able to be connected to the second component, or at least one additional components may be disposed between the first and second components, or the first and second components may be connected or coupled through at least one additional components. In some examples, singular expressions used in the present disclosure include plural expressions unless the context clearly indicates otherwise. In the present disclosure, terms such as "including" or "comprising" should not be construed as necessarily including all of the various components, or various steps described in the present disclosure, and terms such as "including" or "comprising" should be construed as not including some elements or some steps or further including additional elements or steps.

In some examples, singular expressions used in the present disclosure include plural expressions unless the context clearly indicates otherwise. In the present disclosure, terms such as "including" or "comprising" should not be construed as necessarily including all of the various components, or various steps described in the present disclosure, and terms such as "including" or "comprising" should be construed as not including some elements or some steps or further including additional elements or steps.

In the present disclosure, unless otherwise stated, "A and/or B" means A, B, or both. Unless otherwise stated, "C to D" means "C or more and D or less".

Hereinafter, an air conditioner and a method for detecting an incorrectly connected pipe in an air conditioner according to embodiments are described.

FIG. 1 is a schematic diagram of an air conditioner according to an embodiment. Referring to FIG. 1, an air conditioner 100 according to an embodiment may include an outdoor unit 110 and a pipe address setting portion 10 configured to set a pipe address for at least one of indoor units 120 to 140, which are connected to the outdoor unit by wire or wirelessly and through at least one pipe.

In this embodiment, a remote controller to wirelessly transmit the pipe address information to the at least one of indoor units 120 to 124 is described as an example of pipe address setting portion 10. Hereinafter, the remote controller 10 is described as the pipe address setting portion 10 in drawings and the description of the disclosure. However, the pipe address setting portion 10 is not limited thereto and may be implemented as, for example, an input button or a setting button of any one of the indoor units 120 to 140.

The remote controller 10 may receive data to set a pipe address for at least one of indoor units 120 to 140 from a user or a manager and wirelessly and/or wired transmit the received pipe address information to the at least one of indoor units 120 to 140. The at least one of indoor units 120 to 140 may receive the pipe address information from the remote controller 10, and set the pipe address information. After having the pipe address information, the indoor units may transmit the set pipe address information to the outdoor unit 110 through wired communication. However, also a wireless communication of the pipe address information to the outdoor unit may be possible or a mixed mode.

The outdoor unit 110 may determine whether there is an abnormality in the pipe address information received from each of the at least one of the indoor units 120 to 140 and detect incorrectly connected pipes among pipes connected to the at least one of indoor units 120 to 140.

The outdoor unit 110 may perform a serial pipe inspection when a predetermined number of indoor units is connected, for example, three or less indoor units, through pipes. If a higher number than the predetermined number of indoor units is connected to the outdoor unit 110, the outdoor unit 110 may perform a group pipe inspection, for example, when four or more indoor units are connected through pipes, a group pipe inspection may be performed.

Figure 2:
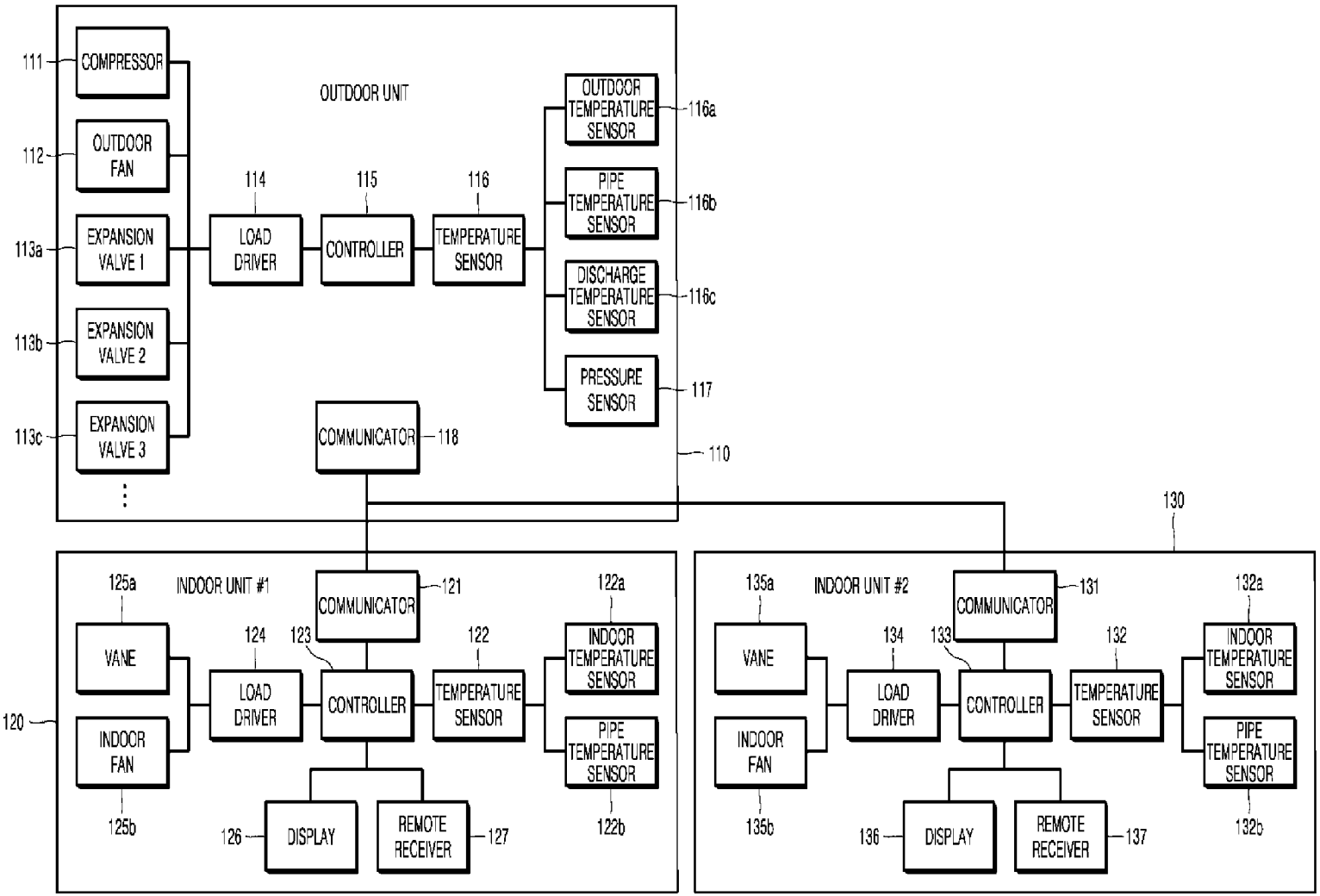
FIG. 2 is a schematic diagram of internal components of an outdoor unit and indoor units according to an embodiment.
Figure 3:
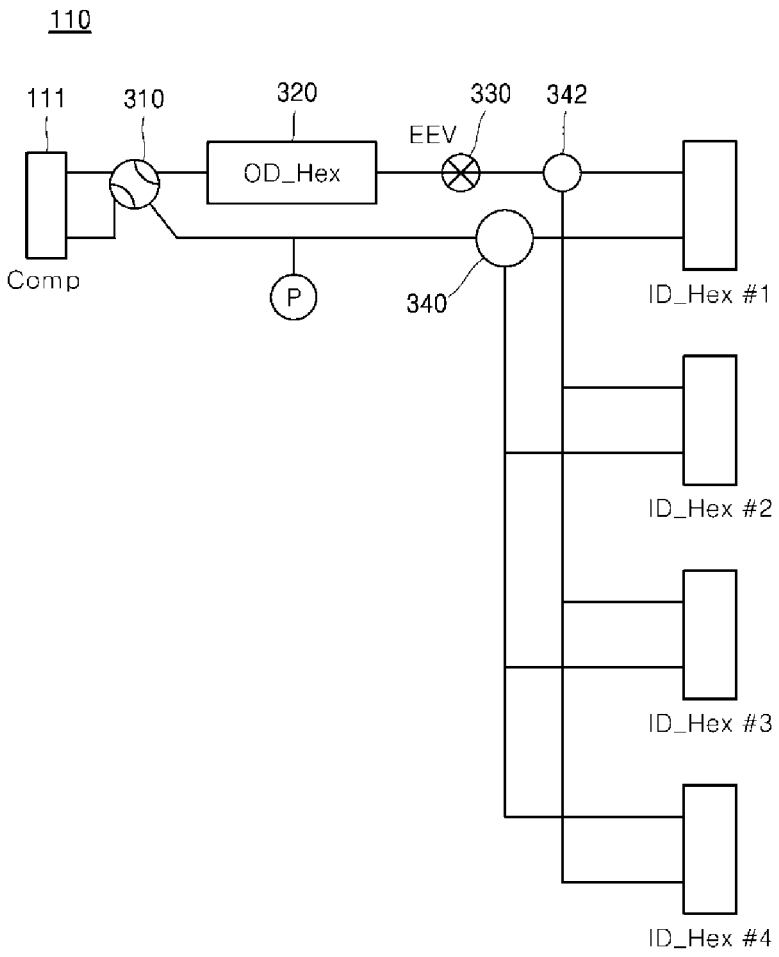
FIG. 3 is a schematic diagram of components of an outdoor unit connected to at least one indoor unit according to an embodiment.

FIG. 2 is a schematic diagram of internal components of an outdoor unit and an indoor unit according to an embodiment. FIG. 3 is a schematic diagram of components of an outdoor unit connected to at least one indoor unit according to an embodiment.

Referring to FIG. 2, outdoor unit 110 according to an embodiment may include at least one of a compressor 111, an outdoor fan 112, expansion valves 113*a* to 113*c*, a load driver 114, a controller 115, a temperature sensor 116, an outdoor temperature sensor 116*a*, a pipe temperature sensor 116*b*, a discharge temperature sensor 116*c*, a pressure sensor 117, and a communicator 118. However, the outdoor unit may have less components. The communicator 118 may be connected to the controller 115.

Referring to FIG. 3, for the outdoor unit 110 according to the embodiment, a 4-way valve 310 may be connected to the compressor 111 in two directions, to an outdoor heat exchanger 320 in a first direction among remaining two directions of the 4-way valve 310, and to a first branch 340 via a pipe (P) in a second direction among the remaining two directions of the 4-way valve 310.

Referring to FIGS. 2 and 3, the compressor 111 may compress introduced refrigerant into high-temperature and high-pressure gas. The outdoor fan 112 may provide the compressed refrigerant with air flow (or pressure) generated based on rotation thereof.

The 4-way valve 310 may adjust a flow direction of refrigerant discharged from the compressor 111 in four directions (i.e., in four ways) according to an operation mode (e.g., a cooling mode or a heating mode). The first branch 340 may be connected to at least one of indoor units 120 to 140 through pipes. The first branch 340 may connect the at least one of indoor units 120 to 140 to the 4-way valve 310.

An electronic expansion valve 330 may be connected to the outdoor heat exchanger 320 and may be connected to the at least one of indoor units 120 to 140 through pipes connected to a second branch 342. The outdoor heat exchanger 320 may condense refrigerant discharged through the 4-way valve 310 or receive refrigerant compressed by the compressor 111 to exchange heat with outdoor air.

The at least one of expansion valves 113*a* to 113*c* may be connected to the at least one of indoor units 120 to 140 and may expand and discharge refrigerant condensed by the outdoor heat exchanger 320. The at least one of expansion valves 113*a* to 113*c* connected to an indoor unit #1 to an indoor unit #3 are shown; however, types of the expansion valves are not limited. Expansion valve 113*d* connected to indoor unit #4, expansion valve 113*e* connected to indoor unit #5, expansion valve 113*f* connected to an indoor unit #6, expansion valve 113*g* connected to indoor unit #7, expansion valve 113*c* connected to indoor unit #8, and expansion valve 113*i* connected to indoor unit #9 may be further added.

The load driver 114 may control a rotational load of the outdoor fan 112. The controller 115 may control operations of the compressor 111, the outdoor heat exchanger 320, and the expansion valves 113*a* to 113*c*.

The outdoor temperature sensor 116*a* may detect an outdoor temperature. The pipe temperature sensor 116*b* may detect a temperature of the pipe through which the refrigerant flows. The discharge temperature sensor 116*c* may detect a temperature of the refrigerant discharged through the pipe. The temperature sensor 116 may convert a temperature signal detected by each of the outdoor temperature sensor 116*a*, the pipe temperature sensor 116*b*, and the discharge temperature sensor 116*c* into digital data and transmit the digital data to the controller 115.

The pressure sensor 117 may detect a discharge pressure of the pipe.

The communicator 118 may communicate with the at least one of indoor units 120 to 140 by wire or wirelessly.

Indoor unit #1 120 may include first indoor heat exchanger (ID_Hex #1), indoor unit #2 130 may include second indoor heat exchanger (ID_Hex #2), indoor unit #3 may include third indoor heat exchanger (ID_Hex #3), and indoor unit #4 may include fourth indoor heat exchanger (ID_Hex #4). Similarly, indoor unit #9 may include ninth indoor heat exchanger (ID_Hex #9). This is exemplary and embodiments are not limited thereto. This arrangement may be applied to a plurality of indoor units. For example, this arrangement may also be applied to an 11th indoor unit or a 20th indoor unit. In this embodiment, indoor unit #1 120 may be referred to as indoor unit #1 (ID_Hex #1), indoor unit #2 130 may be referred to as indoor unit #2 (ID_Hex #2), indoor unit #3 3 may be referred to as indoor unit #3 (ID_Hex #3), and indoor unit #4 may be referred to as indoor unit #4 (ID_Hex #4).

Referring to FIG. 2, indoor unit 120, 130 according to an embodiment may include a communicator 121, 131, at least one temperature sensor 122, 132, at least one indoor temperature sensor 122*a*, 132*a*, one or more pipes temperature sensors 122*b*, 132*b*, a controller 123, 133, a load driver 124, 134, a vane 125*a*, 135*a*, one or more indoor fans 125*b*, 135*b*, one or more displays 126, 136, and a remote receiver 127, 137. Referring to FIG. 2, the indoor units 120 to 130 according to an embodiment may be equipped with the same components. However, they may also be different in their structure.

In FIG. 2, only internal components of indoor unit #1 120 and indoor unit #2 130 are shown. The indoor unit #3 to the indoor unit #9 140 may have the same components and the same functions as the indoor unit #1 120 and the indoor unit #2 130.

The communicators 121 and 131 may communicate with the outdoor unit 110 by wire/wirelessly and transmit and receive data to and from the outdoor unit 110.

Any one of the one or more temperature sensors 122 and 132 may convert temperature signals detected by the one or more indoor temperature sensors 122*a* and 132*a* and the one or more pipe temperature sensors 122*b* and 132*b* into digital data and transmit the digital data to the respective controllers 123 and 133. The one or more indoor temperature sensors 122*a* and 132*a* may detect a temperature of an indoor space in which each indoor unit is installed. The one or more pipe temperature sensors 122*b* and 132*b* may detect a temperature of a pipe connected to each indoor unit.

The respective controllers 123, 133 of the indoor units may control operations of internal components of each indoor unit. The one or more load drivers 124 and 134 may control a rotational load of the vanes 125*a* and 135*a* and the indoor fans 125*b* and 135*b* under control of the controllers 123 and 133. The vanes 125*a* and 135*a* and the indoor fans 125*b* and 135*b* may discharge refrigerant into the indoor space based on the rotation.

The displays 126 and 136 may indicate an operating state of each indoor unit. The remote receivers 127 and 137 may wirelessly receive the pipe address information from the remote controller 10.

Configurations not shown in the drawings, for example, in FIGS. 1 to 3, and operations not described in embodiments may be the same as configurations and operations of air conditioners, which are known in the same technical field.

Figure 4:
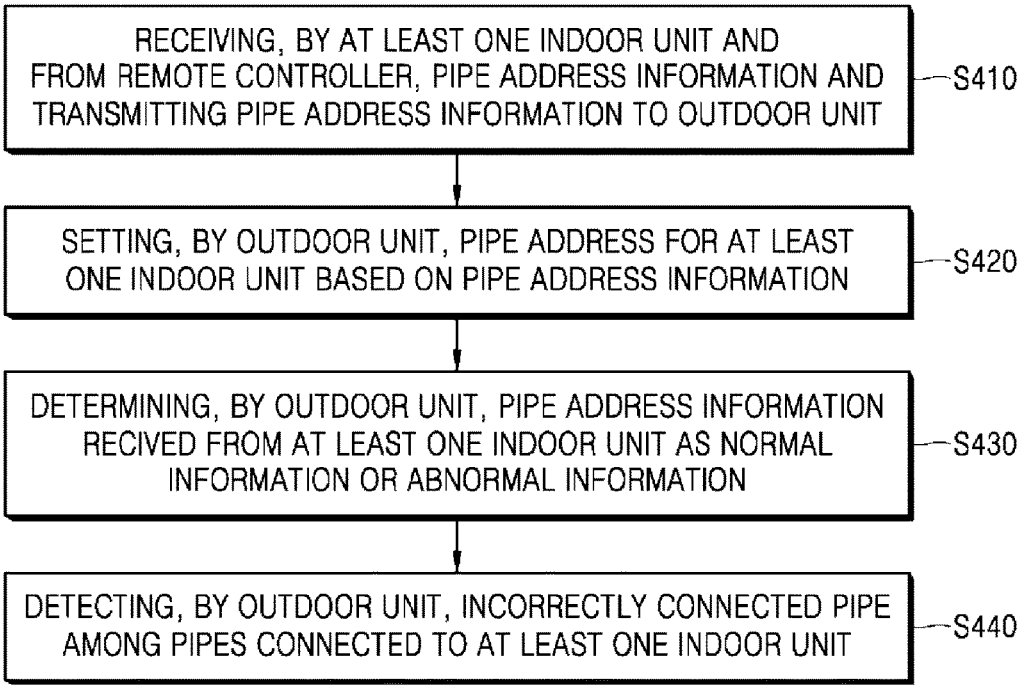
FIG. 4 is a flowchart of a method for detecting an incorrectly connected pipe of an air conditioner according to an embodiment.

FIG. 4 is a flowchart of a method for detecting an incorrectly connected pipe of an air conditioner according to an embodiment. Referring to FIG. 4, for air conditioner 100 according to an embodiment, at least one of indoor units 120 to 140 may receive pipe address information from remote controller 10 and transmit the pipe address information to outdoor unit 110 (S410).

For example, the remote controller 10 may input first pipe address information to indoor unit #1 120, input second pipe address information to indoor unit #2 130, input third pipe address information to indoor unit #3 (ID_Hex #3) according to an input operation by users or managers. Similarly, the remote controller 10 may input pipe address information to indoor unit #9 140. That is, the remote controller 10 may input a ninth pipe address information to the indoor unit #9 140.

Subsequently, the indoor unit #1 120 may transmit the first pipe address information to the outdoor unit 110 through communicator 121 and the indoor unit #2 130 may transmit the second pipe address information to the outdoor unit 110 through communicator 131. Similarly, indoor unit #3 (ID_Hex #3) to indoor unit #9 140 may transmit pipe address information to the outdoor unit 110 through the communicators.

Subsequently, the outdoor unit 110 may set a pipe address for the at least one indoor unit based on the pipe address information received from the indoor units 120 to 140 (S420). That is, the controller 115 of the outdoor unit 110 may set the pipe address for the at least one of indoor units 120 to 140 by allocating the pipe address information received from the at least one of indoor units 120 to 140 to the indoor units (e.g., ID_Hex #1 to ID_Hex #4) and storing the pipe address information to a memory thereof, as shown in FIG. 6.

Subsequently, the outdoor unit 110 may determine the pipe address information received from the at least one of indoor units 120 to 140 as normal information or abnormal information (S430). That is, the controller 115 of the outdoor unit 110 may detect an error to determine whether a duplicate pipe address is allocated to the at least one of indoor units 120 to 140. Additionally, or alternatively, the controller 115 of the outdoor unit 110 may detect whether an allocation of the pipe address to the at least one of indoor units 120 to 140 is omitted, as shown in FIG. 6.

Subsequently, the outdoor unit 110 may detect an incorrectly connected pipe among pipes connected to the at least one of indoor units 120 to 140 (S440). Basically, this subsequently checking whether there is an incorrectly connected pipe among the pipes includes the checking of temperatures in some or more pipes.

A procedure of subsequently checking whether there is an incorrectly connected pipe among the pipes depends on how many indoor units are connected to the outdoor unit. So, depending on the number of indoor units connected to the outdoor unit, different checking procedures may be performed.

That is, the controller 115 of the outdoor unit 110 operates the compressor 111 and controls the electronic expansion valves 113*a* to 113*c* allocated to the at least one indoor unit to introduce refrigerant discharged from the compressor 111 into the at least one indoor unit and determines allocation of a communication address and the pipe address to the at least one indoor unit as a normal allocation or an abnormal allocation based on a temperature change of a pipe temperature sensor configured to detect a temperature of a pipe connected to each of the at least one indoor unit to detect whether pipes are incorrectly connected. In this case, the controller 115 of the outdoor unit 110 may perform a serial pipe inspection when three or less indoor units are connected through the pipes and perform a group pipe inspection when four or more indoor units are connected through the pipes.

Figure 5:
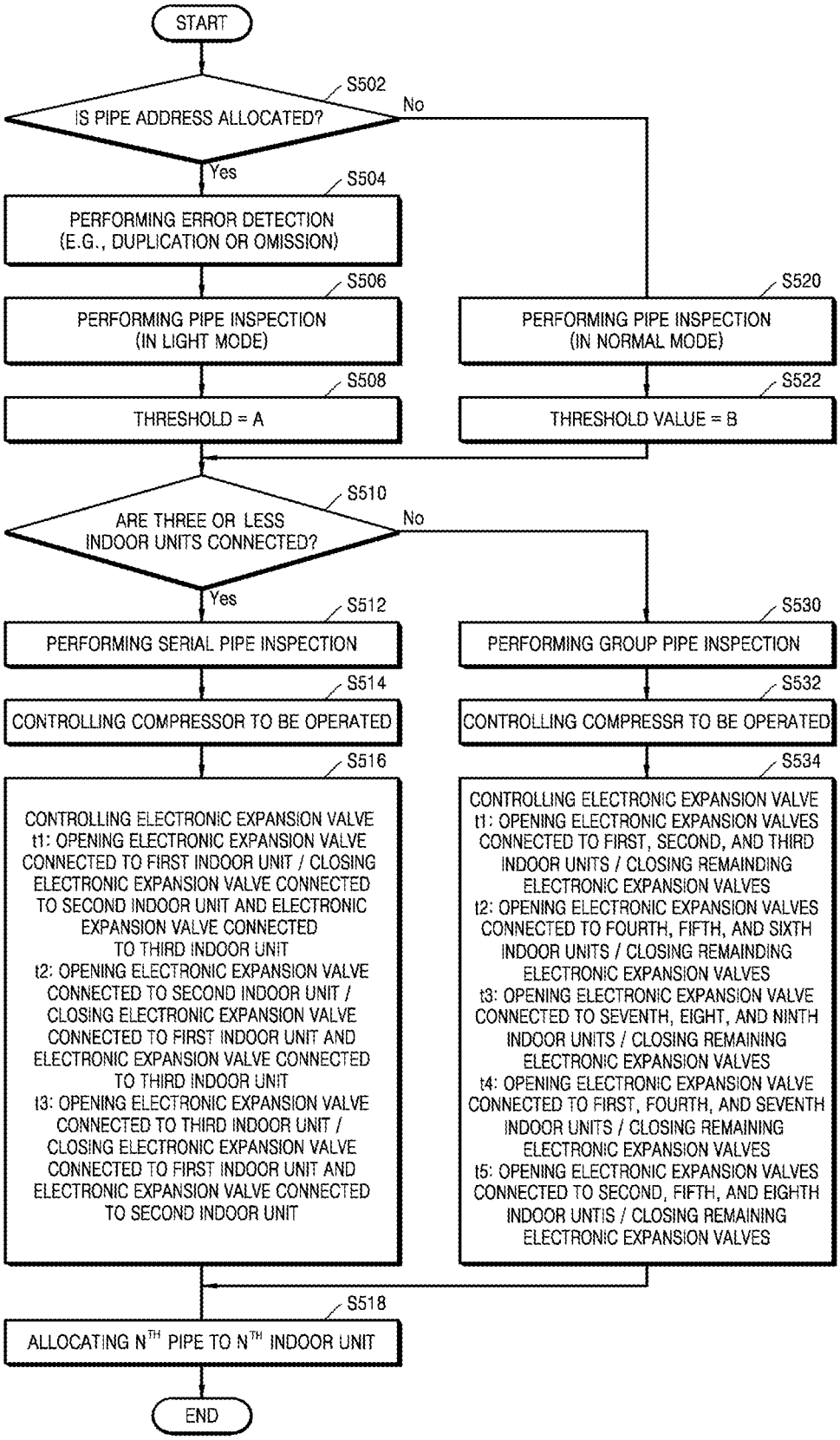
FIG. 5 is a flowchart of a method for performing pipe inspection by an outdoor unit of an air conditioner according to an embodiment.

FIG. 5 is a flowchart of a method for performing pipe inspection by an outdoor unit of an air conditioner according to an embodiment. Referring to FIG. 5, according to this embodiment, controller 115 of outdoor unit 110 may determine allocation or non-allocation of a pipe address to at least one of indoor units 120 to 140 (S502).

The controller 115 of the outdoor unit 110 may allocate the pipe address information received from the at least one of indoor units 120 to 140 to the indoor units (e.g., ID_Hex

#1 to ID_Hex #4) and store the pipe address information in a memory thereof, as shown in FIG. 6.

FIG. 6 shows example pipe address information allocated to each indoor unit, by an outdoor unit, and stored in the outdoor unit, and detection results thereof. As shown in FIG. 6, the controller 115 of the outdoor unit 110 may receive first pipe address information or second pipe address information from the indoor unit #1 120 and store the first pipe address information or the second pipe address information. In addition, for example, the controller 115 of the outdoor unit 110 may receive second pipe address information, the first pipe address information, or fourth pipe address information from the indoor unit #2 130. In addition, for example, the controller 115 of the outdoor unit 110 may receive third pipe address information from the indoor unit #3 (ID_Hex #3) and store the third pipe address information.

When the pipe address is assigned to the at least one of indoor units 120 to 140 (corresponding to "Yes" at S502), the controller 150 of the outdoor unit 110 may detect an error, such as allocation of a duplicate pipe address to the at least one of indoor units 120 to 140 and/or omission of the pipe address allocation to the at least one of indoor units 120 to 140 (S504).

For example, as shown in FIG. 6, the controller 115 of the outdoor unit 110 may determine a state in which a first pipe is allocated to the indoor unit #1 (ID_Hex #1), a second pipe is allocated to the indoor unit #2 (ID_Hex #2), and a third pipe is allocated to the indoor unit #3 (ID_Hex #3) as a normal state. In addition, as shown in FIG. 6, the controller 115 of the outdoor unit 110 may determine a state in which pipes are cross-connected to the indoor unit #1 (ID_Hex #1) and the indoor unit #2 (ID_Hex #2), that is, the second pipe is allocated to the indoor unit #1 (ID_Hex #1) and the first pipe is allocated to the indoor unit #2 (ID_Hex #2), and the third pipe is allocated to the indoor unit #3 (ID_Hex #3) as an undetectable state. Such result might be output at the outdoor unit and/or the indoor unit to inform the user or manager of the air conditioner.

In addition, as shown in FIG. 6, the controller 115 of the outdoor unit 110 may determine a state in which the first pipe is allocated to the indoor unit #1 (ID_Hex #1), the fourth pipe is allocated to the indoor unit #2 (ID_Hex #2), and the third pipe is allocated to the indoor unit #3 (ID_Hex #3) as an error state in which allocation of a second pipe is omitted. Such a result might be output at the outdoor unit and/or the indoor unit to inform the user or manager of the air conditioner.

In addition, as shown in FIG. 6, the controller 115 of the outdoor unit 110 may determine a state in which the first pipe is allocated to the indoor unit #1 (ID_Hex #1), the first pipe is also allocated to the indoor unit #2 (ID_Hex #2), and the third pipe is allocated to the indoor unit #3 (ID_Hex #3) as a duplicate error state in which the first pipe is allocated to the indoor unit #1 (ID_Hex #1) and the indoor unit #2 (ID_Hex #2). This error may be output.

Subsequently, the controller 115 of the outdoor unit 110 may perform a pipe inspection in a light mode (S506). The light mode is a mode in which the pipe inspection is performed when a reference value for a temperature change of an indoor heat exchanger is a value "A". A normal mode is a mode in which a pipe inspection is performed when a reference value for a temperature change of the indoor heat exchanger is a value "B". In this case, "A" is less than "B" (i.e., A<B). So in a case of no address allocation or erroneously address allocation a normal pipe inspection is performed.

That is, the controller 115 of the outdoor unit 110 may set a threshold value for temperature change of each indoor heat exchanger as "A" and performs the pipe inspection in the light mode (S508). Subsequently, the controller 115 of the outdoor unit 110 determines whether a predefined number, e.g. three or less indoor units are connected to the outdoor unit 110 through pipes (S510), and when the predefined number, e.g. three or less indoor units are connected to the outdoor unit 110 through the pipes (corresponding to "Yes" at S510), performs a serial pipe inspection (S512).

According to this embodiment, the serial pipe inspection may be performed by sequentially detecting incorrectly connected pipes among the first pipe to the third pipe connected to the indoor unit #1 to the indoor unit #3. When the three indoor units are connected to the outdoor unit 110, for example, the first pipe is connected to the indoor unit #1 (ID_Hex #1), the second pipe is connected to the indoor unit #2 (ID_Hex #2), and the third pipe is connected to the indoor unit #3 (ID_Hex #3), the controller 115 of the outdoor unit 110 controls electronic expansion valves 113*a* to 113*c* allocated to the indoor unit #1 to the indoor unit #3 to introduce refrigerant discharged from the compressor 111 into the indoor unit #1 to the indoor unit #3 and determines allocation of a communication address and the pipe address to the indoor unit #1 to the indoor unit #3 as normal allocation or abnormal allocation based on a temperature change of a pipe temperature sensor configured to detect a temperature of pipes connected to the indoor units to detect an incorrectly connected pipe.

Subsequently, the controller 115 of the outdoor unit 110 controls the compressor 111 to be operated (S514) and controls electronic expansion valves 113*a* to 113*c* allocated to the indoor unit #1 to the indoor unit #3 as follows (S516). For example, during a first time period (t1), the controller 115 of the outdoor unit 110 opens the electronic expansion valve 113*a* connected to the indoor unit #1 (ID_Hex #1), closes the electronic expansion valve 113*b* connected to the indoor unit #2 (ID_Hex #2) and the electronic expansion valve 113*c* connected to the indoor unit #3 (ID_Hex #3), introduces refrigerant to the indoor unit #1 (ID_Hex #1) connected to the open electronic expansion valve, and determines communication address allocation and pipe address allocation to the indoor unit #1 (ID_Hex #1) as normal allocation or abnormal allocation based on a temperature change of a pipe temperature sensor of the indoor unit #1 (ID_Hex #1).

Subsequently, during a second time period (t2), the controller 115 of the outdoor unit 110 opens the electronic expansion valve connected to the indoor unit #2 (ID_Hex #2), closes electronic expansion valves connected to the indoor unit #1 (ID_Hex #1) and the indoor unit #3 (ID_Hex #3), introduces refrigerant to the indoor unit #2 (ID_Hex #2) connected to the opened electronic expansion valve, and determines communication address allocation and pipe address allocation to the indoor unit #2 (ID_Hex #2) as normal allocation or abnormal allocation based on a temperature change of a pipe temperature sensor of the indoor unit #2 (ID_Hex #2). Subsequently, during a third time period (t3), the controller 115 of the outdoor unit 110 opens the electronic expansion valve connected to the indoor unit #3 (ID_Hex #3), closes the electronic expansion valve connected to the indoor unit #1 (ID_Hex #1) and the electronic expansion valve connected to the indoor unit #2 (ID_Hex #2), introduces refrigerant into the indoor unit #3 (ID_Hex #3) connected to the opened electronic expansion valve, and determines communication address allocation and pipe address allocation to the indoor unit #3 (ID_Hex

#3) as normal allocation or abnormal allocation based on a temperature change of a pipe temperature sensor of the indoor unit #3 (ID_Hex #3).

Based on the determination that the pipes are normally connected to the indoor units, the controller 115 of the outdoor unit 110 allocates an nth pipe to an nth indoor unit (S518). For example, the controller 115 of the outdoor unit 110 allocates first pipe address information to the indoor unit #1 (ID_Hex #1), allocates the second pipe address information to the indoor unit #2 (ID_Hex #2), and allocates the third pipe address information to the indoor unit #3 (ID_Hex #3), stores and records the pipe address information in a memory thereof.

When the pipe address is not allocated (corresponding to "No" at S502), the controller 115 of the outdoor unit 110 performs a pipe inspection in a normal mode (S520). In this case, the controller 115 of the outdoor unit 110 performs the pipe inspection when a reference threshold value for the temperature change of each indoor heat exchanger is set to be "B" (S522).

The threshold value B in the normal mode is greater than the threshold value A in the light mode (i.e., A<B). That is, in the normal mode, the controller 115 of the outdoor unit 110 performs the pipe inspection for the indoor units having the greater temperature change value of the indoor heat exchanger in the normal mode than that of the indoor heat exchanger in the light mode.

Based on the four or more indoor units being connected to the outdoor unit 110 (corresponding to "No" at S510), the controller 115 of the outdoor unit 110 performs a group pipe inspection (S530), as shown in FIG. 7. FIG. 7 shows an example of performing a group pipe inspection by an air conditioner according to an embodiment.

In the group pipe inspection, when the four or more indoor units are connected to the outdoor unit 110 through the pipes, the pipe inspection is performed for each group by grouping three indoor units into one group among the four or more indoor units. As shown in FIG. 7, nine indoor units are connected to the outdoor unit 110 through pipes in this embodiment.

For example, the controller 115 of the outdoor unit 110 groups indoor unit #1 (ID_Hex #1), indoor unit #2 (ID_Hex #2), and indoor unit #3 (ID_Hex #3) into a first group, groups indoor unit #4 (ID_Hex #4), indoor unit #5 (ID_Hex #5), and indoor unit #6 (ID_Hex #6) into a second group, and groups indoor unit #7 (ID_Hex #7), eight indoor unit (ID_Hex #8), and indoor unit #9 (ID_Hex #9) into a third group. In this case, the first pipe may be connected to the indoor unit #1 (ID_Hex #1), the second pipe may be connected to the indoor unit #2 (ID_Hex #2), the third pipe may be connected to the indoor unit #3 (ID_Hex #3), the fourth pipe may be connected to the indoor unit #4 (ID_Hex #4), the fifth pipe may be connected to the indoor unit #5 (ID_Hex #5), the sixth pipe may be connected to the indoor unit #6 (ID_Hex #6), the seventh pipe may be connected to the indoor unit #7 (ID_Hex #7), the eighth pipe may be connected to the indoor unit #8 (ID_Hex #8), and the ninth pipe may be connected to the indoor unit #9 (ID_Hex #9).

According to this embodiment, the group pipe inspection may be performed by detecting incorrectly connected pipes for each group when the indoor units are grouped, and subsequently detecting a pipe incorrectly connected to an nth indoor unit in each group. For example, the controller 115 may detect the incorrectly connected pipes for the first group (including the indoor unit #1 to the indoor unit #3), the second group (including the indoor unit #4 to the indoor unit #6), and the third group (including the indoor unit #7 to the indoor unit #9) and detect pipes which are incorrectly connected to the nth indoor unit, for example, first indoor units in each group (e.g., the indoor unit #1, the indoor unit #4, and the indoor unit #7) and second indoor units in each group (e.g., the indoor unit #2, the indoor unit #5, and the indoor unit #8).

The controller 115 of the outdoor unit 110 may detect the pipe incorrectly connected to the indoor unit #1 to the indoor unit #3 corresponding to the first group. In this case, the controller 115 controls the compressor 111 to be operated (S532) and controls electronic expansion valves 113*a* to 113*c* allocated to the indoor unit #1 to the indoor unit #3 corresponding to the first group as follows (S534). For example, during a first time period (t1), the controller 115 opens electronic expansion valves 113*a*, 113*b*, and 113*c* connected to the indoor unit #1 (ID_Hex #1), the indoor unit #2 (ID_Hex #2), and the indoor unit #3 (ID_Hex #3) belonging to the first group and closes electronic expansion valves connected to the indoor unit #4 (ID_Hex #4) to the indoor unit #9 (ID_Hex #9) belonging to the second group and the third group. In addition, the controller 115 introduces refrigerant into the indoor unit #1 (ID_Hex #1), the indoor unit #2 (ID_Hex #2), and the indoor unit #3 (ID_Hex #3) connected to opened electronic expansion valve and determines communication address allocation and pipe address allocation to the indoor unit #1 (ID_Hex #1), the indoor unit #2 (ID_Hex #2), and the indoor unit #3 (ID_Hex #3) as normal allocation or abnormal allocation based on temperature changes of pipe temperature sensors of the indoor unit #1 (ID_Hex #1), the indoor unit #2 (ID_Hex #2), and the indoor unit #3 (ID_Hex #3) to identify whether the pipes are incorrectly connected.

Further, the controller 115 of the outdoor unit 110 may detect incorrectly connected pipes among pipes connected to the indoor unit #4 to the indoor unit #6 corresponding to the second group. For example, during a second time period (t2), the controller 115 opens electronic expansion valves 113*d*, 113*e*, and 113*f* connected to the indoor unit #4 (ID_Hex #4), the indoor unit #5 (ID_Hex #5), and the indoor unit #6 (ID_Hex #6) belonging to a second group and closes electronic expansion valves connected to the indoor unit #1 (ID_Hex #1) to the indoor unit #3 (ID_Hex #3) belonging to the first group and the indoor unit #7 (ID_Hex #7) to the indoor unit #9 (ID_Hex #9) belonging to the third group. In addition, the controller 115 introduces refrigerant into the indoor unit #4 (ID_Hex #4), the indoor unit #5 (ID_Hex #5), and the indoor unit #6 (ID_Hex #6) connected to the opened electronic expansion valve, and determines allocation of a communication address and the pipe address to the indoor unit #4 (ID_Hex #4), the indoor unit #5 (ID_Hex #5), and the indoor unit #6 (ID_Hex #6) as normal allocation or abnormal allocation based on temperature changes of pipe temperature sensors of the indoor unit #4 (ID_Hex #4), the indoor unit #5 (ID_Hex #5), and the indoor unit #6 (ID_Hex #6) to identify whether the pipes are incorrectly connected.

Furthermore, the controller 115 of the outdoor unit 110 may detect incorrectly connected pipes among pipes connected to the indoor unit #7 to the indoor unit #9 corresponding to the third group. For example, during a third time period (t3), the controller 115 opens electronic expansion valves 113*g*, 113*h*, and 113*i* connected to the indoor unit #7 (ID_Hex #7), the indoor unit #8 (ID_Hex #8), and the indoor unit #9 (ID_Hex #9) belonging to the third group and closes electronic expansion valves connected to the indoor unit #1 (ID_Hex #1) to the indoor unit #6 (ID_Hex #6) belonging to the first group and the second group. In addition, the controller 115 introduces refrigerant into the indoor unit #7

(ID_Hex #7), the indoor unit #8 (ID_Hex #8), and the indoor unit #9 (ID_Hex #9) connected to the opened electronic expansion valve and determines allocation of a communication address and the pipe address to the indoor unit #7 (ID_Hex #7), the indoor unit #8 (ID_Hex #8), and the indoor unit #9 (ID_Hex #9) as normal allocation or abnormal allocation based on temperature changes of pipe temperature sensors of the indoor unit #7 (ID_Hex #7), the indoor unit #8 (ID_Hex #8), and the indoor unit #9 (ID_Hex #9).

In addition, the controller 115 of the outdoor unit 110 may detect a pipe incorrectly connected to first indoor units in each group. For example, the controller 115 opens electronic expansion valves connected to the indoor unit #1 (ID_Hex #1) of the first group, the indoor unit #4 (ID_Hex #4) of the second group, and the indoor unit #7 (ID_Hex #7) of the third group, which correspond to the first indoor units in each group, and closes the electronic expansion valves connected to the indoor unit #2 (ID_Hex #2), the indoor unit #3 (ID_Hex #3), the indoor unit #5 (ID_Hex #5), the indoor unit #6 (ID_Hex #6), the indoor unit #8 (ID_Hex #8), and the indoor unit #9 (ID_Hex #9) during a fourth time period (t4). In addition, the controller 115 introduces refrigerant into the indoor unit #1 (ID_Hex #1), the indoor unit #4 (ID_Hex #4), and the indoor unit #7 (ID_Hex #7) connected the opened electronic expansion valve and determines allocation of a communication address and the pipe address to the indoor unit #1 (ID_Hex #1), the indoor unit #4 (ID_Hex #4), and the indoor unit #7 (ID_Hex #7) as normal allocation or abnormal allocation based on temperature changes of pipe temperature sensors of the indoor unit #1 (ID_Hex #1), the indoor unit #4 (ID_Hex #4), and the indoor unit #7 (ID_Hex #7) to identify whether the pipes are incorrectly connected.

Also, the controller 115 of the outdoor unit 110 may detect incorrectly connected pipes among pipes connected to second indoor units in each group. For example, the controller 115 opens electronic expansion valves connected to the indoor unit #2 (ID_Hex #2) of the first group, the indoor unit #5 (ID_Hex #5) of the second group, and the indoor unit #8 (ID_Hex #8) of the third group, which correspond to the second indoor unit in each group and closes electronic expansion valves connected to the remaining first indoor unit (ID_Hex #1), third indoor unit (ID_Hex #3), fourth indoor unit (ID_Hex #4), sixth indoor unit (ID_Hex #6), seventh indoor unit (ID_Hex #7), and ninth indoor unit (ID_Hex #9). In addition, the controller 115 introduces refrigerant into the indoor unit #2 (ID_Hex #2), the indoor unit #5 (ID_Hex #5), and the indoor unit #8 (ID_Hex #8) connected to the opened electronic expansion valve, and determines allocation of a communication address and a pipe address to the indoor unit #2 (ID_Hex #2), the indoor unit #5 (ID_Hex #5), and the indoor unit #8 (ID_Hex #8) as normal allocation or abnormal allocation based on temperature changes of pipe temperature sensors of the indoor unit #2 (ID_Hex #2), the indoor unit #5 (ID_Hex #5), and the indoor unit #8 (ID_Hex #8) to identify whether the pipes are incorrectly connected.

Based on the determination that the pipes are normally allocated to the indoor units, the controller 115 of the outdoor unit 110 may allocate an nth pipe to an nth indoor unit (S518).

FIG. 8 shows an example of performing a group pipe inspection when an air conditioner includes seven indoor units according to an embodiment. Referring to FIG. 8, according to an embodiment, air conditioner 100 may perform the group pipe inspection by grouping three indoor units into one group when seven or more indoor units are connected to an outdoor unit 110.

For example, controller 115 of the outdoor unit 110 may group indoor unit #1 (ID_Hex #1), indoor unit #2 (ID_Hex #2), and indoor unit #3 (ID_Hex #3) into a first group, group indoor unit #4 (ID_Hex #4), indoor unit #5 (ID_Hex #5), and indoor unit #6 (ID_Hex #6) into a second group, and group indoor unit #7 (ID_Hex #7) into a third group. The indoor unit #1 (ID_Hex #1) may be connected to a first pipe, the indoor unit #2 (ID_Hex #2) may be connected to a second pipe, the indoor unit #3 (ID_Hex #3) may be connected to a third pipe, the indoor unit #4 (ID_Hex #4) may be connected to a fourth pipe, the indoor unit #5 (ID_Hex #5) may be connected to the fifth pipe, the indoor unit #6 (ID_Hex #6) may be connected to the sixth pipe, and the indoor unit #7 (ID_Hex #7) may be connected to a seventh pipe.

The group pipe inspection for the seven indoor units may be performed by detecting incorrectly connected pipes for each group and subsequently detecting pipes incorrectly connected to an nth indoor unit in each group. For example, the controller 115 detects incorrectly connected pipes among the pipes connected to the indoor units for the first group (including the indoor unit #1 to the indoor unit #3), the second group (including the indoor unit #4 to the indoor unit #6), and the third group (including the indoor unit #7) and subsequently detects incorrectly connected pipes among the pipes connected to the nth indoor unit in each group, for example, first indoor units in each group (e.g., the indoor unit #1, the indoor unit #4, and the indoor unit #7) and second indoor units in each group (e.g., the indoor unit #2 and the indoor unit #5).

The controller 115 of the outdoor unit 110 detects the pipes incorrectly connected to the indoor unit #1 to the indoor unit #3 corresponding to the first group. In this case, the controller 115 controls the compressor 111 to be operated and controls the electronic expansion valves 113*a* to 113*c* allocated to the indoor unit #1 to the indoor unit #3 belonging to the first group as follows. For example, during a first time period (t1), the controller 115 opens electronic expansion valves 113*a*, 113*b*, and 113*c* connected to the indoor unit #1 (ID_Hex #1), the indoor unit #2 (ID_Hex #2), and the indoor unit #3 (ID_Hex #3) belonging to a first group and closes electronic expansion valves connected to the indoor unit #4 (ID_Hex #4) to the indoor unit #7 (ID_Hex #7) belonging to the remaining second group and the third group. In addition, the controller 115 introduces refrigerant into the indoor unit #1 (ID_Hex #1), the indoor unit #2 (ID_Hex #2), and the indoor unit #3 (ID_Hex #3) connected to the opened electronic expansion valve and determines allocation of a communication address and a pipe address to the indoor unit #1 (ID_Hex #1), the indoor unit #2 (ID_Hex #2), and the indoor unit #3 (ID_Hex #3) as normal allocation or abnormal allocation based on temperature change of pipe temperature sensors of the indoor unit #1 (ID_Hex #1), the indoor unit #2 (ID_Hex #2), and the indoor unit #3 (ID_Hex #3) to identify whether the pipes are incorrectly connected.

Subsequently, the controller 115 of the outdoor unit 110 detects pipes incorrectly connected to the indoor unit #4 to the indoor unit #6 corresponding to the second group. For example, during a second time period (t2), the controller 115 opens electronic expansion valves 113*d*, 113*e* and 113*f* connected to the indoor unit #4 (ID_Hex #4), the indoor unit #5 (ID_Hex #5), and the indoor unit #6 (ID_Hex #6) belonging to a second group and closes electronic expansion valve connected to the indoor unit #1 (ID_Hex #1) to the indoor unit #3 (ID_Hex #3) belonging to the first group and the indoor unit #7 (ID_Hex #7) belonging to the third group. In addition, the controller 115 introduces refrigerant into the indoor unit #4 (ID_Hex #4), the indoor unit #5 (ID_Hex #5), and the indoor unit #6 (ID_Hex #6) connected to the opened electronic expansion valve, and determines allocation of a communication address and the pipe address to the indoor unit #4 (ID_Hex #4), the indoor unit #5 (ID_Hex #5), and the indoor unit #6 (ID_Hex #6) as normal allocation or abnormal allocation based on temperature changes of pipe temperature sensors of the indoor unit #4 (ID_Hex #4), the indoor unit #5 (ID_Hex #5), and the indoor unit #6 (ID_Hex #6) to identify whether the pipes are incorrectly connected.

Subsequently, the controller 115 of the outdoor unit 110 detects pipes incorrectly connected to the indoor unit #7 corresponding to the third group. For example, during a third time period (t3), the controller 115 opens an electronic expansion valve 113*g* connected to the indoor unit #7 (ID_Hex #7) in the third group and closes the electronic expansion valves connected to the indoor unit #1 (ID_Hex #1) to the indoor unit #6 (ID_Hex #6) belonging to the first group and the second group. In addition, the controller 115 introduces refrigerant into the indoor unit #7 (ID_Hex #7) connected to the opened electronic expansion valve and determines allocation of a communication address and pipe address to the indoor unit #7 (ID_Hex #7) as normal allocation or abnormal allocation based on a temperature change of a pipe temperature sensor of the indoor unit #7 (ID_Hex #7) to identify whether pipe are incorrectly connected.

Subsequently, the controller 115 of the outdoor unit 110 may detect pipes incorrectly connected to first indoor units in each group. For example, during a fourth time period (t4), the controller 115 opens electronic expansion valves connected to the indoor unit #1 (ID_Hex #1) of the first group, the indoor unit #4 (ID_Hex #4) of the second group, and the indoor unit #7 (ID_Hex #7) of the third group, which correspond to the first indoor units in each group and closes the electronic expansion valve connected to the indoor unit #2 (ID_Hex #2), the indoor unit #3 (ID_Hex #3), the indoor unit #5 (ID_Hex #5), and the indoor unit #6 6 (ID_Hex #6). In addition, the controller 115 introduces refrigerant into the indoor unit #1 (ID_Hex #1), the indoor unit #4 (ID_Hex #4), and the indoor unit #7 (ID_Hex #7) connected to the opened electronic expansion valve, and determines allocation of a communication address and the pipe address to the indoor unit #1 (ID_Hex #1), the indoor unit #4 (ID_Hex #4), and the indoor unit #7 (ID_Hex #7) as normal allocation or abnormal allocation based on temperature changes of pipe temperature sensors of the indoor unit #1 (ID_Hex #1), the indoor unit #4 (ID_Hex #4), and the indoor unit #7 (ID_Hex #7) to identify whether the pipes are incorrectly connected.

Subsequently, the controller 115 of the outdoor unit 110 may detect pipes incorrectly connected to second indoor units in each group. For example, during a fifth time period (t5), the controller 115 opens an electronic expansion valve connected to the indoor unit #2 (ID_Hex #2) of the first group and the indoor unit #5 (ID_Hex #5) of the second group, which correspond to the second indoor unit of each group, and closes the electronic expansion valves connected to the remaining first indoor unit (ID_Hex #1), third indoor unit (ID_Hex #3), fourth indoor unit (ID_Hex #4), sixth indoor unit (ID_Hex #6), and seventh indoor unit (ID_Hex #7). In addition, the controller 115 introduces refrigerant into the indoor unit #2 (ID_Hex #2) and the indoor unit #5 (ID_Hex #5) connected to the opened electronic expansion valve and determines allocation of a communication address and the pipe address to the indoor unit #2 (ID_Hex #2) and the indoor unit #5 (ID_Hex #5) as normal allocation or abnormal allocation based on temperature changes of pipe temperature sensors of the indoor unit #2 (ID_Hex #2) and the indoor unit #5 (ID_Hex #5) to identify whether the pipes are incorrectly connected.

Based on the determination that the pipes are normally connected to the indoor units, the controller 115 of the outdoor unit 110 may allocate an nth pipe to an nth indoor unit.

FIG. 9 shows an example of performing a group pipe inspection when an air conditioner includes five indoor units according to an embodiment. Referring to FIG. 9, air conditioner 100 according to an embodiment may perform the group pipe inspection by grouping three indoor units into one group when five or more indoor units are connected to an outdoor nit 110 through pipes.

For example, controller 115 of the outdoor unit 110 may group indoor unit #1 (ID_Hex #1), indoor unit #2 (ID_Hex #2), and indoor unit #3 (ID_Hex #3) into a first group and group indoor unit #4 (ID_Hex #4) and indoor unit #5 (ID_Hex #5) into a second group. In this case, the indoor unit #1 (ID_Hex #1) may be connected to a first pipe, the indoor unit #2 (ID_Hex #2) may be connected to a second pipe, the indoor unit #3 (ID_Hex #3) may be connected to a third pipe, the indoor unit #4 (ID_Hex #4) may be connected to a fourth pipe, and the indoor unit #5 (ID_Hex #5) may be connected to a fifth pipe.

The group pipe detection for the five indoor units may be performed by detecting incorrectly connected pipes for each group and subsequently detecting pipes incorrectly connected to an nth indoor unit in each group. For example, the controller 115 detects the pipes incorrectly connected to the indoor unit for the first group (including the indoor unit #1 to the indoor unit #3) and the second group (including the indoor unit #4 and the indoor unit #5) and subsequently detects the pipes incorrectly connected to the nth indoor unit in each group, for example, the indoor unit #1 in each group (e.g., the indoor unit #1 and the indoor unit #4) and the indoor unit #2 in each group (e.g., the indoor unit #2 and the indoor unit #5).

The controller 115 of the outdoor unit 110 detects pipes incorrectly connected to the indoor unit #1 to the indoor unit #3 corresponding to the first group. In this case, the controller 115 controls compressor 111 to be operated and controls electronic expansion valves 113*a* to 113*c* allocated to the indoor unit #1 to the indoor unit #3 corresponding to the first group as follows. For example, during a first time period (t1), the controller 115 opens the electronic expansion valves 113*a*, 113*b*, and 113*c* connected to the indoor unit #1 (ID_Hex #1), the indoor unit #2 (ID_Hex #2), and the indoor unit #3 (ID_Hex #3) belonging to the first group and closes electronic expansion valves connected to the indoor unit #4 (ID_Hex #4) and the indoor unit #5 (ID_Hex #5) belonging to the second group. In addition, the controller 115 introduces refrigerant into the indoor unit #1 (ID_Hex #1), the indoor unit #2 (ID_Hex #2), and the indoor unit #3 (ID_Hex #3) connected to the opened electronic expansion valve and determines allocation of a communication address and the pipe address to the indoor unit #1 (ID_Hex #1), the indoor unit #2 (ID_Hex #2), and the indoor unit #3 (ID_Hex #3) as normal allocation or abnormal allocation based on temperature changes of pipe temperature sensors of the indoor unit #1 (ID_Hex #1), the indoor unit #2 (ID_Hex #2), and the indoor unit #3 (ID_Hex #3) to identify whether the pipes are incorrectly connected.

Subsequently, the controller 115 of the outdoor unit 110 detects pipes incorrectly connected to the indoor unit #4 and the indoor unit #5 belonging to the second group. For example, during a second time period (t2), the controller 115 opens the electronic expansion valves 113*d* and 113*e* connected to the indoor unit #4 (ID_Hex #4) and the indoor unit #5 (ID_Hex #5) belonging to the second group and closes the electronic expansion valve connected to the indoor unit #1 (ID_Hex #1) to the indoor unit #3 (ID_Hex #3) belonging to the remaining first group. In addition, the controller 115 introduces refrigerant into the indoor unit #4 (ID_Hex #4) and the indoor unit #5 (ID_Hex #5) connected to the opened electronic expansion valve and determines allocation of a communication address and the pipe address to the indoor unit #4 (ID_Hex #4) and the indoor unit #5 (ID_Hex #5) as normal allocation or abnormal alocation based on temperature changes of pipe temperature sensors of the indoor unit #4 (ID_Hex #4) and the indoor unit #5 (ID_Hex #5) to identify whether the pipes are incorrectly connected.

Subsequently, the controller 115 of the outdoor unit 110 may detect pipes incorrectly connected to a first indoor unit in each group. For example, during a third time period (t3), the controller 115 opens the electronic expansion valves connected to the indoor unit #1 (ID_Hex #1) of the first group and the indoor unit #4 (ID_Hex #4) of the second group, which correspond to the first indoor unit in each group, and closes the electronic expansion valves connected to the indoor unit #2 (ID_Hex #2), the indoor unit #3 (ID_Hex #3), and the indoor unit #5 (ID_Hex #5). In addition, the controller 115 introduces refrigerant into the indoor unit #1 (ID_Hex #1) and the indoor unit #4 (ID_Hex #4) connected to the opened electronic expansion valve determines allocation of a communication address and the pipe address to the indoor unit #1 (ID_Hex #1) and the indoor unit #4 (ID_Hex #4) as normal allocation or abnormal allocation based on temperature changes of pipe temperature sensors of the indoor unit #1 (ID_Hex #1) and the indoor unit #4 (ID_Hex #4) to identify whether the pipes are incorrectly connected.

Subsequently, the controller 115 of the outdoor unit 110 may detect pipes incorrectly connected to a second indoor unit in each group. For example, during a fourth time period (t4), the controller 115 opens the electronic expansion valves connected to the indoor unit #2 (ID_Hex #2) of the first group and the indoor unit #5 (ID_Hex #5) of the second group, which correspond to the second indoor units in each group, and closes the electronic expansion valves connected to the remaining first indoor unit (ID_Hex #1), third indoor unit (ID_Hex #3), and fourth indoor unit (ID_Hex #4). In addition, the controller 115 introduces refrigerant into the indoor unit #2 (ID_Hex #2) and the indoor unit #5 (ID_Hex #5) connected to the opened electronic expansion valve and determines allocation of a communication address and the pipe address to the indoor unit #2 (ID_Hex #2), and the indoor unit #5 (ID_Hex #5) as normal allocation or abnormal allocation based on temperature changes of pipe temperature sensors of the indoor unit #2 (ID_Hex #2) and the indoor unit #5 (ID_Hex #5) to identify whether the pipes are incorrectly connected. Subsequently, based on the determination that the pipes are normally connected to the indoor units, the controller 115 of the outdoor unit 110 may allocate an nth pipe to an nth indoor unit.

According to embodiments disclosed herein, when four or more indoor units are connected to the outdoor unit, incorrectly connected pipes may be detected for each group by grouping three indoor units into one group. Further, according to embodiments disclosed herein, even if the pipe addresses are allocated by inputting pipe address data through the input means from outside, the pipe connection errors (e.g., the duplication or the omission) may be detected through the error detection according to embodiments disclosed herein. Furthermore, the pipe detection may be performed in parallel, thereby reducing detection time thereof.

A time period for which the incorrectly connected pipe is detected may be reduced by adjusting a temperature change reference value of the pipe of the indoor unit, compared to an operation of setting the pipe address and an address temperature based on data input by the user. The pipe inspection may be performed by changing a state of the electronic expansion valve from a closed state to an open state, thereby reducing the pipe inspection time period.

Embodiments disclosed herein provide an air conditioner capable of detecting incorrectly connected pipes among the pipes connecting the outdoor unit to the indoor units, and a method for detecting an incorrectly connected pipe in an air conditioner thereof. Further, embodiments disclosed herein provide an air conditioner capable of easily detecting an incorrectly connected pipe among pipes connecting an outdoor unit to indoor units and a method for detecting an incorrectly connected pipe in an air conditioner. Furthermore, embodiments disclosed herein provide an air conditioner capable of recognizing an incorrectly connected pipe among pipes and which is further able to quickly check a correctness of the connection of pipes and/or which is able to differentiate a process of checking depending on a number of indoor units connected.

Embodiments are not limited to what has been described. Additionally, other advantages which are not mentioned may be understood by the description and more clearly understood based on the embodiments. Further, it will be readily understood that the advantages of embodiments disclosed herein may be implemented by features defined in claims and a combination thereof.

An air conditioner and method according to embodiments disclosed herein should be able to only check a temperature-change portion of an indoor heat exchanger when detecting an incorrectly connected pipe among pipes connecting an outdoor unit to the indoor units, without waiting for stabilization of all cycles, thereby shortening a time period for which the incorrectly connected pipe is detected.

Further, the air conditioner according to embodiments disclosed herein can easily differentiate which way of checking is performed depending on the number of indoor units connected.

For an air conditioner according to embodiments disclosed herein, at least one indoor unit may be connected to an outdoor unit through pipes, each indoor unit may transmit pipe address information received from a remote controller to the outdoor unit, and the outdoor unit may determine whether there is an abnormality in the pipe address information received from each indoor unit, and perform a pipe inspection depending on a number of indoor units connected to the outdoor unit. The outdoor unit may perform a serial pipe inspection when predetermined number of indoor unit, for example, three or less indoor units, are connected to the outdoor unit through the pipes, and perform a group pipe inspection when more than the predetermined number of indoor units, for example, four or more indoor units, are connected to the outdoor unit through the pipes.

According to some embodiments, in the group pipe inspection, the outdoor unit may be configured to detect the pipe incorrectly connected to the indoor unit for each group and subsequently detect a pipe incorrectly connected to an nth indoor unit in each group. In the serial pipe inspection, the outdoor unit may be configured to sequentially detect pipes incorrectly connected to the indoor units.

According to some embodiments, the outdoor unit may include a compressor configured to discharge refrigerant, a 4-way valve configured to adjust a flow direction of the discharged refrigerant in four directions, a branch configured to connect the at least one indoor unit to the 4-way valve, an outdoor heat exchanger configured to heat-exchange the refrigerant with outdoor air, at least one expansion vale connected to the at least one indoor unit, and a controller configured to control an air-conditioning operation of the outdoor unit. The outdoor unit may include at least one of: a communicator configured to communicate with the indoor unit, an outdoor temperature sensor configured to detect an outdoor temperature, a pipe temperature sensor configured to detect a temperature of the pipe, a discharge temperature sensor configured to detect a temperature of the discharged refrigerant, a pressure sensor configured to detect a discharge pressure of the refrigerant, or a temperature sensor configured to convert a temperature signal detected by each temperature sensor into digital data.

The outdoor unit may determine whether a duplicate pipe address is allocated to the at least one indoor unit and/or allocation of the pipe address to the at least one indoor unit is omitted based on the pipe address information received from the at least one indoor unit.

According to embodiments disclosed herein, in the serial pipe inspection, the outdoor unit may be configured to operate the compressor and control the expansion valve allocated to each indoor unit to introduce the refrigerant discharged from the compressor into the at least one indoor unit, open an electronic expansion valve connected to an indoor unit #1 and close remaining electronic expansion valves during a first time period, open an electronic expansion valve connected to the indoor unit #2 and close remaining electronic expansion valves during a second time period, open the electronic expansion valve connected to the indoor unit #3 and close remaining electronic expansion valves during a third time period to introduce the refrigerant into the indoor unit connected to the opened electronic expansion valve, and determine whether a communication address and the pipe address are each normally allocated to the at least one indoor unit based on a temperature change of the pipe temperature sensor. The outdoor unit may be configured to perform the group pipe inspection by grouping three indoor units into one group when four or more indoor units are connected through the pipes. In the group pipe inspection, the outdoor unit may be configured to operate the compressor and control an expansion valve allocated to each indoor unit to introduce refrigerant discharged from the compressor into the at least one indoor unit, open the electronic expansion valves connected to the indoor unit #1, the indoor unit #2, and the indoor unit #3 belonging to a first group and close remaining electronic expansion valves during a first time period, open electronic expansion valves connected to an indoor unit #4, an indoor unit #5, and an indoor unit #6 belonging to a second group and close remaining electronic expansion valves during a second time period, open electronic expansion valves connected to an indoor unit #7, an indoor unit #8, and an indoor unit #9 belonging to a third group and close remaining electronic expansion valves during a third time period, open electronic expansion valves connected to the indoor unit #1, the indoor unit #4, and the indoor unit #7, which correspond to a first indoor unit in each group and close remaining electronic expansion valves during a fourth time period, open electronic expansion valves connected to the indoor unit #2, the indoor unit #5, and the indoor unit #8, which correspond to a second indoor unit in each group and close remaining electronic expansion valves during a fifth time period, introduce the refrigerant into the indoor unit connected to the opened electronic expansion valve, and determine whether the communication address and the pipe address are normally allocated to the at least one indoor unit based on a temperature change of the pipe temperature sensor.

According to embodiments disclosed herein, the indoor unit may include a communicator configured to communicate with the outdoor unit, a remote receiver configured to receive the pipe address information, an indoor fan configured to discharge refrigerant into an indoor space, a controller configured to control a rotational load, an indoor temperature sensor configured to detect an indoor temperature, a pipe temperature sensor configured to detect a temperature of the pipe, a temperature sensor configured to covert the temperature detected by each temperature sensor into digital data, and a display configured to indicate an operating state of each component.

According to embodiments disclosed herein, a method for detecting an incorrectly connected pipe of an air conditioner may include receiving, by at least one indoor unit and from at least one remote controller, pipe address information and transmitting the pipe address information to an outdoor unit, setting, by the outdoor unit, pipe address for the at least one indoor unit based on the pipe address information, determining, by the outdoor unit, the pipe address information as normal information or abnormal information, and detecting, by the outdoor unit, an incorrectly connected pipe among pipes connected to the at least one indoor unit. In this case, the outdoor unit may be configured to perform a serial pipe inspection when three or less indoor units are connected to the outdoor unit through the pipes and may perform a group pipe inspection by grouping three indoor units into one group when four or more indoor units are connected to the outdoor unit through the pipes.

According to embodiments disclosed herein, the air conditioner may easily set an initial address value of a system for each indoor unit using an additional remote control device. Errors such as allocation of a duplicate address or omission of an address allocation may be detected within a shorter time than before based on an address value set for the indoor unit. Correct connection to all indoor units may be easily checked by detecting whether the pipes are cross-connected to the outdoor unit and the indoor units.

According to embodiments disclosed herein, when the four or more indoor units are connected to the outdoor unit through the pipes, the incorrectly connected pipes may be detected by grouping three indoor units into one group. In this case, as a large number of indoor units are connected, a stabilization time period of a refrigeration cycle may be reduced, and thus, a time period for which errors are detected may be reduced.

As addresses are already allocated to each indoor unit, a temperature change threshold of the indoor unit may be immediately applied to the indoor unit having the allocated address based on the address. In this case, the threshold change may be less than the threshold change in other inspection method. In addition, the indoor unit identified as being in an error state may be found based on the address thereof and the threshold may vary according to the corresponding to indoor unit and may be applied to the indoor unit.

According to embodiments disclosed herein, a state of the electronic expansion valve (EEV) may be changed from a closed state to an open state (i.e., Close→Open), not from the open state to the closed state (i.e., Open→Close), thereby facilitating the stabilization of the refrigeration cycle.

In the method in the related art, about four minutes of stabilization time may be consumed per one indoor unit, that is, 36 minutes of error detection time may be consumed for nine indoor units. In embodiments disclosed herein, three indoor units are grouped into one group among the nine indoor units and identification of the addresses of all indoor units may be completed by only five detections. That is, 20 minutes of detection time may be consumed. Therefore, the error detection by grouping in embodiments disclosed herein may consume a shorter time.

The error detection in embodiments disclosed herein may be performed by comparing with already known information. So, the error detection may be performed by identifying only a temperature change portion of an indoor heat exchanger without waiting for stabilization of all cycles. Therefore, the error detection time may be reduced from four minutes for each indoor unit to two minutes to a time period less than four minutes for each indoor unit.

According to embodiments disclosed herein, when the indoor units are sequentially inspected or when the indoor units are inspected by grouping to detect a pipe incorrectly connected to the indoor unit, inspection accuracy of the incorrectly connected pipe may be improved by differently setting a criteria to determine a normal inspection combination.

According to embodiments disclosed herein, even when an automatic inspection is performed in a state in which the address is not allocated to each indoor unit, inspection accuracy thereof may be improved by differently setting the criteria to determine the normal inspection combination.

According to embodiments disclosed herein, the air conditioner and the method for detecting the incorrectly connected pipe may enable shortening the detection time period from 20 minutes to 8 to 16 minutes for five indoor units and shortening the detection time period from 36 minutes to 10 to 20 minutes for nine indoor units.

Further advantages, in addition to the above-mentioned advantages, are described together while describing specific matters for implementing the embodiments.

Embodiments have been described with reference to drawings hereinabove; however, the embodiments are not limited to the embodiments and the exemplary drawings herein, and various modifications can be made by the skilled person in the art within the scope of the technical idea. Further, even if working effects obtained based on configurations are not explicitly described in the description of embodiments, effects predictable based on the corresponding configuration have to be recognized.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

an outdoor unit;

at least one indoor unit connected to the outdoor unit through at least one pipe; and a pipe address setting portion configured to set a pipe address for each of the at least one indoor unit, wherein the at least one indoor unit is configured to:

receive pipe address information from the pipe address setting portion and set the pipe address information, and transmit the set pipe address information to the outdoor unit, and wherein the outdoor unit is configured to:

determine whether there is an abnormality in the pipe address information received from each of the at least one indoor unit; and detect an incorrectly connected pipe among pipes connected to the at least one indoor unit by performing a serial pipe inspection when a predetermined number or less of indoor units is connected to the outdoor unit through the pipes and performing a group pipe inspection when more than the predetermined number of indoor units is connected to the outdoor unit through the pipes, wherein the predetermined number is three.

2. The air conditioner of claim 1, wherein, in the group pipe inspection, the outdoor unit is configured to detect a pipe incorrectly connected to the indoor unit for each group and subsequently detect a pipe incorrectly connected to an nth indoor unit in each group and/or, in the serial pipe inspection, the outdoor unit is configured to sequentially detect a pipe incorrectly connected to each indoor unit.

3. The air conditioner of claim 1, wherein the outdoor unit comprises at least one of:

a compressor configured to compress refrigerant into high-temperature and high-pressure gas;

a 4-way valve configured to adjust a flow direction of the refrigerant discharged from the compressor according to an operation mode;

a branch configured to connect the at least one indoor unit to the 4-way valve;

an outdoor heat exchanger configured to condense the refrigerant discharged through the 4-way valve or receive the refrigerant compressed by the compressor to exchange heat with outdoor air;

at least one expansion valve connected to the at least one indoor unit and configured to expand and discharge the refrigerant condensed by the outdoor heat exchanger; and a controller configured to control operations of the compressor, the outdoor heat exchanger, and the at least one expansion valve.

4. The air conditioner of claim 3, wherein the outdoor unit further comprises at least one of:

a communicator configured to communicate with each of the at least one indoor unit;

an outdoor temperature sensor configured to detect an outdoor temperature;

a pipe temperature sensor configured to detect a temperature of the at least one pipe;

a discharge temperature sensor configured to detect a temperature of the refrigerant discharged through the at least one pipe;

a pressure sensor configured to detect a discharge pressure of the at least one pipe; or a temperature sensor configured to convert a temperature signal detected by each of the outdoor temperature sensor, the pipe temperature sensor, and the discharge temperature sensor into digital data and transmit the digital data to the controller.

5. The air conditioner of claim 4, wherein, in the serial pipe inspection and the group pipe inspection, the outdoor unit is configured to:

operate the compressor;

control an expansion valve allocated to each indoor unit to introduce refrigerant discharged from the compressor into the at least one indoor unit; and determine whether a communication address and the pipe address are each normally allocated to the at least one indoor unit based on a temperature change sensed by the pipe temperature sensor.

6. The air conditioner of claim 4, wherein, in the serial pipe inspection, the outdoor unit is configured to:

operate the compressor;

control an expansion valve allocated to each indoor unit to introduce the refrigerant discharged from the compressor into the at least one indoor unit;

open the expansion valve connected to a first indoor unit and close the expansion valve connected to a second indoor unit and the expansion valve connected to a third indoor unit;

open the expansion valve connected to the second indoor unit and close the expansion valve connected to the first indoor unit and the expansion valve connected to the third indoor unit;

open the expansion valve connected to the third indoor unit and close the expansion valve connected to the first indoor unit and the expansion valve connected to the second indoor unit; and introduce refrigerant into the indoor unit connected to each open expansion valve and determine whether the communication address and the pipe address are each normally allocated to the indoor unit based on a temperature change sensed by the pipe temperature sensor.

7. The air conditioner of claim 4, wherein the outdoor unit is configured to perform the group pipe inspection by grouping three indoor units into one group among the at least one indoor unit, and wherein, in the group pipe inspection, the outdoor unit is configured to:

operate the compressor, and control an expansion valve allocated to each indoor unit to introduce refrigerant discharged from the compressor into the at least one indoor unit;

open the expansion valve connected to a first indoor unit, the expansion valve connected to a second indoor unit, and the expansion valve connected to a third indoor unit and close the expansion valves corresponding to a second group and a third group, wherein the first indoor unit, the second indoor unit, and the third indoor unit belong to a first group;

open the expansion valve connected to a fourth indoor unit, the expansion valve connected to a fifth indoor unit, and the expansion valve connected to a sixth indoor unit and close the expansion valves belonging to the first group and the third group, wherein the fourth indoor unit, the fifth indoor unit, and the sixth indoor unit belong to the second group;

open the expansion valve connected to a seventh indoor unit, the expansion valve connected to an eighth indoor unit, and the expansion valve connected to a ninth indoor unit and close the expansion valves corresponding to the first group and the second group, wherein the seventh indoor unit, the eighth indoor unit, and the ninth indoor unit belong to the third group;

open the expansion valve connected to the first indoor unit, the expansion valve connected to the fourth indoor unit, and the expansion valve connected to the seventh indoor unit and close the remaining expansion valves, wherein the first indoor unit, the fourth indoor unit, and the seventh indoor unit correspond to a first indoor unit in each group;

open the expansion valve connected to the second indoor unit, the expansion valve connected to the fifth indoor unit, and the expansion valve connected to the eighth indoor unit and close the remaining expansion valves, wherein the second indoor unit, the fifth indoor unit, and the eighth indoor unit correspond to a second indoor unit in each group; and introduce refrigerant into the indoor unit connected to each open expansion valve and determine whether the communication address and the pipe address are normally allocated to the at least one indoor unit based on a temperature change sensed by the pipe temperature sensor.

8. The air conditioner of claim 1, wherein the outdoor unit is configured to determine whether a duplicate pipe address is allocated to the at least one indoor unit and/or allocation of the pipe address to the at least one indoor unit is omitted based on the pipe address information received from the at least one indoor unit.

9. The air conditioner of claim 8, wherein the outdoor unit is configured to:

determine a state in which a first pipe is connected to a first indoor unit, a second pipe is connected to a second indoor unit, and a third pipe is connected to a third indoor unit as a normal state;

determine a state in which the first pipe is connected to the first indoor unit, a fourth pipe is connected to the second indoor unit, and the third pipe is connected to the third indoor unit as an omission error state; and/or determine a state in which the first pipe is connected to the first indoor unit, the first pipe is connected to the second indoor unit, and the third pipe is connected to the third indoor unit as a duplicate error state.

10. The air conditioner of claim 1, wherein each of the at least one indoor unit comprises at least one of:

a communicator configured to communicate with the outdoor unit;

a remote receiver configured to wirelessly receive the pipe address information from the pipe address setting portion;

an indoor fan configured to discharge, into an indoor space, refrigerant introduced from the outdoor unit through the pipe;

a load driver configured to control a rotational load of the indoor fan;

a controller configured to control the remote receiver and the load driver;

a indoor temperature sensor configured to detect a room temperature;

a pipe temperature sensor configured to detect a temperature of the at least one pipe to introduce refrigerant from the outdoor unit;

a temperature sensor configured to convert a temperature signal detected by each of the indoor temperature sensor and the pipe temperature sensor into digital data and transmit the digital data to the controller; or a display configured to indicate a reception state of the pipe address information, the detected indoor temperature, the detected pipe temperature, and an operating state of the indoor fan on a screen.

11. The air conditioner of claim 1, wherein the at least one indoor unit and/or the outdoor unit each comprises a memory configured to store the pipe address information.

12. The air conditioner of claim 1, wherein the pipe address setting portion comprises a remote controller.

13. A method for detecting an incorrectly connected pipe of an air conditioner, the air conditioner comprising at least one indoor unit and an outdoor unit connected to each other through pipes, the method comprising:

transmitting, by the at least one indoor unit, pipe address information to the outdoor unit;

setting, by the outdoor unit, a pipe address for the at least one indoor unit based on the received pipe address information;

determining, by the outdoor unit, the pipe address information received from the at least one indoor unit as normal information or abnormal information; and detecting, by the outdoor unit, an incorrectly connected pipe among pipes connected to the at least one indoor unit, wherein, in the detecting, the outdoor unit is configured to perform a serial pipe inspection when three or less indoor units are connected to the outdoor unit through the pipes and perform a group pipe inspection by grouping three indoor units into one group when four or more indoor units are connected to the outdoor unit through the pipes.

14. The method of claim 13, wherein, in the determining, the outdoor unit is configured to operate a compressor, control an expansion valve allocated to each of the at least one indoor unit to introduce refrigerant discharged from the compressor into the at least one indoor unit, and identify allocation of a communication address and the pipe address to the at least one indoor unit as a normal allocation or an abnormal allocation based on a temperature change sensed by a pipe temperature sensor to detect a temperature of a pipe connected to each of the at least one indoor unit to determine the pipe address information as the normal information or the abnormal information.

15. The method of claim 13, wherein, in the detecting, the outdoor unit is configured to:

operate a compressor and control an expansion valve allocated to each of the at least one indoor unit to introduce refrigerant discharged from the compressor into the at least one indoor unit;

open the expansion valve connected to a first indoor unit and close the expansion valve connected to a second indoor unit and the expansion valve connected to a third indoor unit;

subsequently open the expansion valve connected to the second indoor unit and close the expansion valve connected to the first indoor unit and the expansion valve connected to the second indoor unit;

subsequently open the expansion valve connected to the third indoor unit and close the expansion valve connected to the first indoor unit and the expansion valve connected to the second indoor unit; and introduce refrigerant into the indoor unit connected to each open expansion valve, determine allocation of a communication address and the pipe address to the at least one indoor unit as a normal allocation or an abnormal allocation based on a temperature change sensed by the pipe temperature sensor.

16. The method of claim 13, wherein, in the detecting, the outdoor unit is configured to detect the incorrectly connected pipe for each group and subsequently detect a pipe incorrectly connected to an nth indoor unit in each group.

17. The method of claim 16 wherein, in the detecting, the outdoor unit is configured to:

operate the compressor and control an expansion valve allocated to each of the at least one indoor unit to introduce refrigerant discharged from the compressor into the at least one indoor unit;

open the expansion valve connected to a first indoor unit, the expansion valve connected to a second indoor unit, and the expansion valve connected to a third indoor unit and close the expansion valves corresponding to a second group and a third group, wherein the first indoor unit, the second indoor unit, and the third indoor unit belong to a first group;

open the expansion valve connected to a fourth indoor unit, the expansion valve connected to a fifth indoor unit, and the expansion valve connected to a sixth indoor unit and close the expansion valves corresponding to the first group and the third group, wherein the fourth indoor unit, the fifth indoor unit, and the sixth indoor unit belong to the second group, open the expansion valve connected to a seventh indoor unit, the expansion valve connected to an eighth indoor unit, and the expansion valve connected to a ninth indoor unit and close the expansion valves corresponding to the first group and the second group, wherein the seventh indoor unit, the eighth indoor unit, and the ninth indoor unit belong to the third group;

open the expansion valve connected to the first indoor unit, the expansion valve connected to the fourth indoor unit, and the expansion valve connected to the seventh indoor unit and close the remaining expansion valves, wherein the first indoor unit, the fourth indoor unit, and the seventh indoor unit correspond to a first indoor unit in each group;

open the expansion valve connected to the second indoor unit, the expansion valve connected to the fifth indoor unit, and the expansion valve connected to the eighth indoor unit and close the remaining expansion valves, wherein the second indoor unit, the fifth indoor unit, and the eighth indoor unit correspond to a second indoor unit in each group; and introduce refrigerant into the indoor unit connected to each open expansion valve and determine allocation of a communication address and the pipe address to the at least one indoor unit as a normal allocation or an abnormal allocation based on a temperature change sensed by the pipe temperature sensor.

18. An air conditioner, comprising:

an outdoor unit;

a plurality of indoor units connected to the outdoor unit by a plurality of pipes; and a remote controller configured to set a pipe address for each of the at least one indoor unit, wherein each of the plurality of indoor units is configured to:

receive pipe address information from the remote controller and set the pipe address information and transmit the set pipe address information to the outdoor unit, and wherein the outdoor unit is configured to:

determine whether there is an abnormality in the pipe address information received from each of the plurality of indoor units; and detect an incorrectly connected pipe among pipes connected to the plurality of indoor units by performing a serial pipe inspection or a group pipe inspection based on a number of the plurality of indoor units connected to the outdoor unit.

19. The air conditioner of claim 18, wherein the outdoor unit is configured to perform a serial pipe inspection when the number of indoor units is a predetermined number or less, and wherein, in the serial pipe inspection, the outdoor unit is configured to:

operate the compressor;

control an expansion valve allocated to each indoor unit of the plurality of indoor units to introduce the refrigerant discharged from the compressor into the plurality of indoor units;

open the expansion valve connected to a first indoor unit of the plurality of indoor units and close the expansion valve connected to a second indoor unit and the expansion valve connected to a third indoor unit;

open the expansion valve connected to the second indoor unit and close the expansion valve connected to the first indoor unit and the expansion valve connected to the third indoor unit;

open the expansion valve connected to the third indoor unit and close the expansion valve connected to the first indoor unit and the expansion valve connected to the second indoor unit; and introduce refrigerant into the indoor unit connected to each open expansion valve and determine whether the communication address and the pipe address are each normally allocated to the indoor unit based on a temperature change sensed by the pipe temperature sensor.

20. The air conditioner of claim 18, wherein the outdoor unit is configured to perform a group pipe inspection when the number of indoor units is more than a predetermined number by grouping three indoor units into one group among the plurality of indoor units, and wherein, in the group pipe inspection, the outdoor unit is configured to:

operate the compressor, and control an expansion valve allocated to each indoor unit of the plurality of indoor units to introduce refrigerant discharged from the compressor into the at least one indoor unit;

open the expansion valve connected to a first indoor unit of the plurality of indoor units, the expansion valve connected to a second indoor unit, and the expansion valve connected to a third indoor unit and close the expansion valves corresponding to a second group and a third group, wherein the first indoor unit, the second indoor unit, and the third indoor unit belong to a first group;

open the expansion valve connected to a fourth indoor unit, the expansion valve connected to a fifth indoor unit, and the expansion valve connected to a sixth indoor unit and close the expansion valves belonging to the first group and the third group, wherein the fourth indoor unit, the fifth indoor unit, and the sixth indoor unit belong to the second group;

open the expansion valve connected to a seventh indoor unit, the expansion valve connected to an eighth indoor unit, and the expansion valve connected to a ninth indoor unit and close the expansion valves corresponding to the first group and the second group, wherein the seventh indoor unit, the eighth indoor unit, and the ninth indoor unit belong to the third group;

open the expansion valve connected to the first indoor unit, the expansion valve connected to the fourth indoor unit, and the expansion valve connected to the seventh indoor unit and close the remaining expansion valves, wherein the first indoor unit, the fourth indoor unit, and the seventh indoor unit correspond to a first indoor unit in each group;

open the expansion valve connected to the second indoor unit, the expansion valve connected to the fifth indoor unit, and the expansion valve connected to the eighth indoor unit and close the remaining expansion valves, wherein the second indoor unit, the fifth indoor unit, and the eighth indoor unit correspond to a second indoor unit in each group; and introduce refrigerant into the indoor unit connected to each open expansion valve and determine whether the communication address and the pipe address are normally allocated to the at least one indoor unit based on a temperature change sensed by the pipe temperature sensor.

* * * * *